US005605265A

United States Patent [19]

Hanna

[11] Patent Number: 5,605,265

[45] Date of Patent: Feb. 25, 1997

[54] ROLL PAPER TOWEL ADAPTER

[75] Inventor: Emmanuel A. Hanna, Lakeview Terrace, Calif.

[73] Assignee: Bobrick Washroom Equipment, Inc., North Hollywood, Calif.

[21] Appl. No.: 438,056

[22] Filed: May 8, 1995

[51] Int. Cl.[6] ..... B65H 35/04

[52] U.S. Cl. ..... 225/46; 225/88; 225/80; 206/409; 242/595

[58] Field of Search ..... 242/595; 206/409, 206/395; 225/88, 46, 54, 81, 80

[56] References Cited

U.S. PATENT DOCUMENTS

| | | | |
|---|---|---|---|
| 3,045,883 | 7/1962 | Andrews et al. | 225/46 X |
| 3,173,590 | 3/1965 | Bahnsen | 225/46 X |
| 4,811,878 | 3/1989 | Horinchi | 225/46 |

*Primary Examiner*—Rinaldi I. Rada
*Assistant Examiner*—Elizabeth Stanley
*Attorney, Agent, or Firm*—Pretty, Schroeder, Brueggemann & Clark

[57] ABSTRACT

An adapter for enabling a single sheet towel dispenser to dispense towels from a roll. The single sheet towel dispenser has a housing with an access opening and a towel support tray within the housing, the tray having a dispenser slot for movement of a towel resting on the tray downward through the slot and outward to the access opening. The adapter has a first member and a second member, each having a lower section and an upper section, with the members joined together at the lower sections to define a towel passage therebetween, with the towel passage of a size to slide downward through the dispenser slot of the tray, and with the upper sections of the members curving away from each other and each terminating in a support section for resting on the tray.

7 Claims, 2 Drawing Sheets

ROLL PAPER TOWEL ADAPTER

BACKGROUND OF THE INVENTION

This invention relates to towel dispensers and, in particular, to an adapter suitable for converting a dispenser designed for handling single sheet towels to a dispenser for handling towels in continuous rolls.

A typical single sheet towel dispenser has a housing with an internal support tray for a stack of individual sheets. These sheets typically are of paper and may have a Z-fold configuration or a compressed C configuration. There is an access opening in the housing, and a dispenser slot in the tray which permits a user to reach through the opening and grasp an edge of a towel at the dispenser slot to pull the bottom towel from the stack and out the access opening.

Another form of conventional towel dispenser is used with a roll of paper and a mechanism, typically a lever and gear drive, for moving the free end of the roll outward through a slot for grasping by the user to tear off a piece of the towel.

There is an increased demand for roll towel type dispensers as they require less refurnishing and rolls are often lower in cost then stacks of single towels. Accordingly, it is an object of the present invention to provide an adapter which can be readily inserted into a conventional single sheet towel dispenser to permit use of a roll, rather than having to remove an existing dispenser and replace it with a new roll dispenser.

The utilization of the adapter of the invention provides for dispensing of roll towels without the conventional handle. Such a configuration satisfies the handicapped code requirement for access. If the conventional lever is used, the positioning of the dispenser normally needs to be lowered so that the lever is available to a wheelchair user, which requires repositioning the dispenser on or in the wall.

Other objects, advantages, features and results will more fully appear in the course of the following description.

SUMMARY OF THE INVENTION

The adapter of the present invention enables a single sheet towel dispenser to dispense towels from a roll. The single sheet dispenser has a housing with an access opening and a towel support tray within the housing, with the tray having a dispenser slot for movement of a towel resting on the tray downward through the slot and outward to the access opening.

The presently preferred embodiment of the adapter has a first member and a second member, each having a lower section and an upper section with the members joined together at the lower sections to define a towel passage therebetween, with the towel passage of a size to slide downward through the dispenser slot of the tray, and with the upper sections curving away from each other and each terminating in a support section for resting on the tray.

The adapter includes a strip of adhesive material with a peelable protective layer carried on each of the support sections for attaching the adapter to the tray. In the preferred embodiment, each of the support sections is a separate piece attached to the corresponding member such that the contact zones of the support section and tray are overlapping.

The rear member has a paper guide lip at the lower section projecting forward beyond the bottom edge of the front member lower section, and the front member lower section has a serrated bottom edge.

DESCRIPTION OF THE PREFERRED EMBODIMENT

Figure 1:
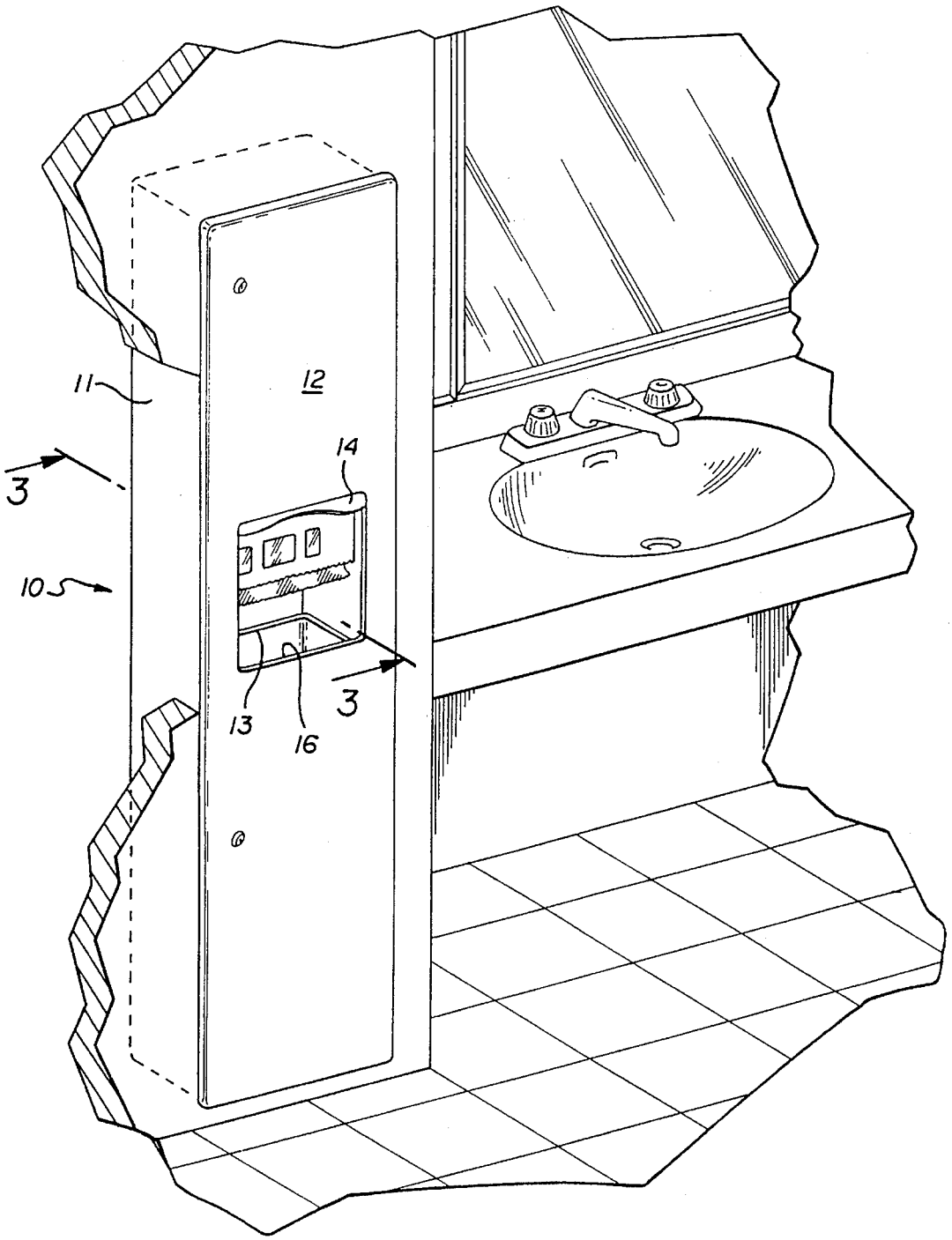
FIG. 1 is a view of a washroom with a towel cabinet incorporating the presently preferred embodiment of the adapter of the invention.
Figure 2:
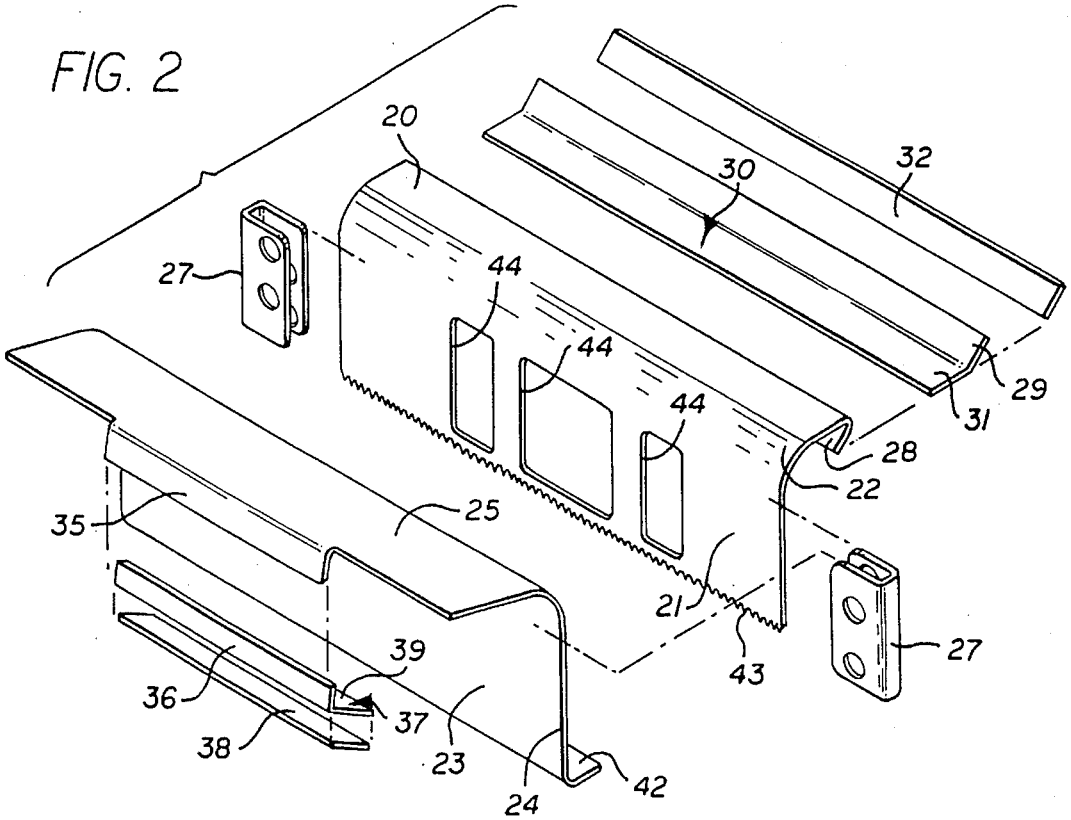
FIG. 2 is an exploded view of the adapter.

A towel dispenser 10 is shown in FIG. 1 installed in the wall of a washroom. The dispenser housing includes a body 11 and a cover 12, usually hinged to the body along the side. A supply of towels is positioned within the housing in the upper portion, and a waste container 13 is positioned in the lower portion of the housing.

In the conventional design, a stack of single sheet towels rest on a towel support tray 14 attached to the body. A dispenser slot 15 is provided in the tray 14 for feeding towels, and an access opening 16 in the cover provides for manual grasping of a towel at the dispenser slot. Different manufacturers provide dispensers with different shapes for the towel support tray 14, including flat and curved. The design of the adapter of the present invention may be varied to fit these various existing dispensers.

The presently preferred embodiment of the adapter of the invention is shown installed in the housing in FIG. 1. The adapter includes a front member 20 with a lower section 21 and a curved upper section 22, and a rear member 23 with a lower section 24 and a curved upper section 25.

The two members are joined with their lower sections spaced from each other to define a towel passage 26, typically formed by U-shaped connectors 27 at each side, with openings providing for spot welding the components together.

In the preferred embodiment illustrated, the first member 20 is formed in two portions with a return bend 28 at the curved upper section 22 attached to a mating portion 29 of a piece 30. Piece 30, which comprises portions 29 and 31, is a housing tray contact section attached to return bend 28 of front member 20, such that the contact zone between piece 30 and towel support tray 14 is overlapping. A strip 32 of adhesive material is attached to the portion 29, with a peelable protective layer on the exposed surface of the strip. In an alternative construction, a portion 31 may be provided on the piece 30, with the adhesive strip 32 on the portion 31 for a different shape of the tray 14.

A similar construction is used for the rear member 23 with a bend 35 attached to a mating portion 36 of a piece 37 and with a strip of adhesive 38 on portion 39 of the piece 37. Piece 37, which comprises portions 36 and 39, is another housing tray contact section that is attached to bend 35 of rear member 23 such that the contact zone between 37 and towel support tray 14 overlaps. In an alternative construction, the piece 37 may be omitted, with the adhesive strip 38 on the bend 35, for a different shape of the tray 14.

The front and rear members 20, 23, the U-shaped connectors 27, and the pieces 30, 37 preferably are formed of sheet steel and are joined by spot welding.

Figure 3:
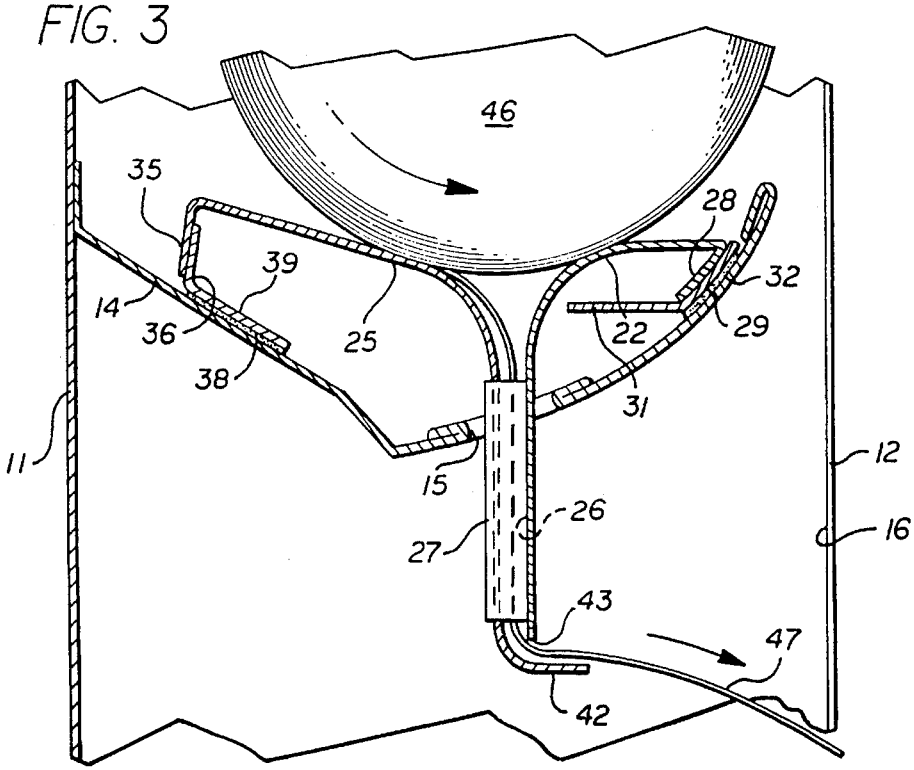
FIG. 3 is an enlarged partial sectional view of the dispenser of FIG. 3 with the adapter in place.

Preferably a lip 42 is formed at the bottom of the lower section 24 of the rear member 23 to serve as a guide for paper, as best seen in FIG. 3, making it easier to grasp the free end of the paper through the access opening 16. Also, preferably a serrated edge 43 is provided at the bottom of the lower section 21 of the first member 20 for ease of tearing off a portion of the towel. One or more windows 44 may be provided in the lower section 21 of the front member 20 to provide access to the paper for moving paper downward through the towel passage 26.

The adapter is easily installed in an existing sheet dispenser by opening the cover and removing any stacked sheets therein. The protective layers are removed from the adhesive strips 32, 38 and the adapter is placed in position on the existing tray 14 with the lower sections of the members which form the towel passage 26 positioned through the existing dispenser slot 15. The portions 29 and 39 of the pieces 30 and 37 are designed to have the same shape as the corresponding portions of the tray 14 to provide good contact for the adhesive material with the tray.

Next a roll 46 of towel is rested on the curved upper sections 22, 25, with the end 47 of the roll 46 fed downward through the towel passage 26 and outward over the lip 42. The cover is then closed.

A user reaches through the access opening 16 and if there is an exposed edge of the paper, pulls outward and downward to draw the desired length of paper and then pulls upward to tear the paper off at the edge 43. If there is no free end of the paper exposed, the user engages the paper through an opening 44 and moves the paper downward to expose a free end. Then the desired amount of paper is pulled outward and torn off by an upward pull against the serrated edge.

While flat upper sections could be used in place of the curved upper sections 22 and 25, the curved surfaces are preferred to reduce friction and tearing of the paper, typically when a new roll of substantial weight is in place. Of course, as paper is consumed, the weight of the roll reduces.

Preferably the rear curved upper section 25 of the rear member 23 of the adapter is slightly lower at the top than the front member 20, to cause the paper roll to rest always towards the back and not roll towards the cabinet door. Rolling against the door increases friction and may make a banging noise.

I claim:

1. An adapter for use with a single sheet towel dispenser to dispense towels from a roll, the single sheet towel dispenser having a housing with a towel support tray fixed within said housing, said tray having a dispenser slot for movement of a towel from said tray downward through said slot;

said adapter having a front member and a rear member, each of the front and rear members having a lower section and an upper section, with the lower section of said front member joined together with the lower section of said rear member to define a towel passage therebetween, with said towel passage of a size to slide a towel downward through said dispenser slot of said tray;

with the upper sections of the front and rear members curving away from each other and each of the upper sections terminating in a housing tray contact section for resting on said tray of said single sheet dispenser housing, with said adapter positioned onto said tray from above said tray for support by said tray, with said towel passage projecting downward through said tray dispenser slot for guiding paper from a roll resting on the upper sections of the front and rear members without contact of the towel with said tray.

2. An adapter for use with a single sheet towel dispenser to dispense towels from a roll.

the single sheet towel dispenser having a housing with an access opening and a towel support tray within said housing, said tray having a dispenser slot for movement of a towel from said tray downward through said dispenser slot and outward through said access;

said adapter having a front member and a rear member, each of the front and rear members having a lower section and an upper section, with the lower section of said front member joined together with the lower section of said rear member to define a towel passage therebetween, with said towel passage of a size to slide a towel downward through said dispenser slot of said tray;

with the upper sections of the front and rear members curving away from each other and each of the upper sections terminating in a housing tray contact section for resting on said tray of said single sheet dispenser housing, and a strip of adhesive material with a peelable protective layer carried on each housing tray contact section for attaching said adapter to said tray.

3. An adapter as defined in claim 2 wherein each housing tray contact section is a separate piece attached to each corresponding front and rear member such that a zone of contact between each housing tray contact section and tray is overlapping.

4. An adapter as defined in claim 2 wherein said front member lower section has a bottom edge and said lower section of said rear member has a paper guide lip projecting forward beyond said bottom edge of said front member lower section.

5. An adapter as defined in claim 4 wherein said front member lower section has a serrated bottom edge.

6. An adapter as defined in claim 5 wherein the front and rear member lower sections have outer edges and said adapter includes U-shaped connectors joining the outer edges of the front member lower section to the outer edges of the rear member lower section to define said towel passage.

7. An adapter as defined in claim 6 wherein said upper section of said front member projects upward beyond said upper section of said rear member.

* * * * *